US005307899A

United States Patent [19]

Lubinski

[11] Patent Number: 5,307,899

[45] Date of Patent: May 3, 1994

[54] PUMP JACK SCAFFOLD

[76] Inventor: Ronald Lubinski, 40 Centennial Heights Court, Meaford, Ontario, Canada, N0H 1Y8

[21] Appl. No.: 991,349

[22] Filed: Dec. 15, 1992

[51] Int. Cl.[5] ..... E04G 1/20

[52] U.S. Cl. ..... 182/136; 182/178; 182/82; 248/246

[58] Field of Search ..... 182/179, 178, 133–136, 182/82; 52/637, 638, 726.1–726.8; 248/297.2, 246

[56] References Cited

U.S. PATENT DOCUMENTS

| | | | |
|---|---|---|---|
| 3,513,606 | 5/1970 | Jones | 248/297.2 X |
| 3,848,844 | 11/1974 | Barrett | 248/297.2 X |
| 4,382,488 | 5/1983 | Anderson | 182/178 X |
| 4,432,435 | 2/1984 | Anderson | 182/82 |
| 4,481,748 | 11/1984 | D'Alessio et al. | 182/179 X |

FOREIGN PATENT DOCUMENTS

| | | | |
|---|---|---|---|
| 1940842 | 2/1970 | Fed. Rep. of Germany | 182/178 |
| 70182 | 4/1929 | Sweden | 182/179 |
| 1136599 | 12/1968 | United Kingdom | 52/726.2 |

*Primary Examiner*—Alvin C. Chin-Shue
*Attorney, Agent, or Firm*—Mirek A. Waraksa

[57] ABSTRACT

A pump jack scaffold includes a pair of extruded aluminum poles. Each pole has a rectangular cross-section. Wood is adhered to one side wall of each pole, providing a surface a jack mechanism can grip. Each of the other three side walls is extruded with a longitudinal structure, internal to the pole, which defines a lengthwise T-slot opening into the exterior of the associated sidewall. Bolts are insert into the T-slots to fasten braces, which can be used either to engage an adjacent building structure, to join the uprights to define a more unitary structure, or to render the scaffold self-supporting. Each pole is separable into upper and lower sections for transportation. The sections are joined by a resilient internal bridging member which is extruded of aluminum. It has an elongate central portion, webs extending radially from the central part, and a bracing portion terminating each web and engaging a corner of the pole. Upper and lower locking pins extend through aligned openings formed in the pole sections and the bridging member to secure the sections. The bracing portions are spaced to define longitudinal slots that closely receive the internal longitudinal structures extruded with the pole, reinforcing the pole against twisting.

4 Claims, 4 Drawing Sheets

PUMP JACK SCAFFOLD

FIELD OF THE INVENTION

The invention relates to pump jack scaffolds, and more particularly, to pump jack scaffolds incorporating aluminum poles.

BACKGROUND OF THE INVENTION

Pump jack scaffolds are well known. They are temporary structures commonly used to support workmen beside a building structure that requires new construction, repair or maintenance. A pump jack frame comprises only two uprights and relies on the building structure itself for support. A brace is normally extended between each upright and the building structure for such purposes. A jack mechanism encircles each upright, and the pair of jack mechanisms support a work platform. The jack mechanisms are usually pedal-operated to rise on the upright and often have hand-operated cranks that permit lowering. In the past, the uprights have been wood beams, which can be readily gripped by the jack mechanisms. Extruded rectangular aluminum poles are now displacing wood beams. With aluminum poles, a friction material such as wood or rubber is riveted or screwed to one side wall to provide an appropriate gripping surface for a jack mechanism.

There are several shortcomings in current practices relating to pump jack scaffolds with aluminum poles. There is a tendency for the uprights to twist, which contributes to failure of the scaffold. This problem relates to the lack of proper bracing. Another consideration is how to provide adequate bracing between the uprights. Another issue is how to conveniently provide a fall arrestor to ensure worker safety. Yet another problem relates to attachment of the required friction material. Care must be taken to properly recess rivets or screws to avoid interference with the operation of a jack mechanism. Such fasteners have been known to shear, and the friction material has been known to break or pull away from the pole proximate to such fasteners, particularly if rubber is involved. Another problem relates to transportation and general handling. To accommodate two-story buildings, uprights with a length between 20–30 feet are typically required. Such lengths are unwieldy for general transportation. Proposals have been made to provide separable upper and lower sections with an internal bridging joining the two, but lack of torsional rigidity remains a problem. Lastly, it will be desirable in some applications that a pump jack scaffold be made free-standing. Nailing or bolting to a roof to stabilize the pump jack structure may not always be acceptable.

In its various aspects, the invention addresses such shortcomings in prior practices.

SUMMARY OF THE INVENTION

In a pump jack scaffold comprising a pair of uprights, a platform, and a pair of jack mechanisms each secured to a different one of the uprights and supporting the platform, each upright comprises an elongate extruded aluminum pole. The pole has a generally rectangular outer cross-section, a pair of parallel side walls with substantially flat outer surfaces, and a hollow interior. A longitudinal structure is extruded in the interior with one of the pair of parallel side walls. The extruded internal structure defines a longitudinal slot with a constricted mouth that opens lengthwise into the outer surface of the associated side wall. Friction material is secured over the majority of the outer surface of the other parallel side wall and may be operatively engaged by the jack mechanism secured to the upright.

The configuration of the uprights permits a variety of brace assemblies to be secured to the uprights at various vertical positions either to fasten to a building structure, to cross-brace the uprights, to provide a displaceable anchoring rail for a fall-arresting device, or to render the scaffold self-supporting. In each instance, the brace assembly may be secured to one of the uprights with securing means comprising a fastener (preferably a simple bolt) with an enlarged portion received in and shaped for displacement along the slot of the upright and a portion extending outwardly through the constricted mouth of the slot, a connector attached to the brace assembly and shaped to receive the outwardly-extending fastener portion, and a complementary fastener (preferably a nut) cooperating with a outwardly-extending portion to secure the connector to the pole.

To fasten to a building structure, the brace assembly associated with an upright may comprise an elongate brace with one end portion pivoted to the connector described above. A plate-like fastening element adapted to be nailed or screwed to the building structure may be secured with another pivot connection to an opposing end portion of the brace. A key advantage of the arrangement is that only "push-pull" forces are applied to the upright because of the position of the slot in the sidewall opposite the friction material. This avoids torsional forces that tend to collapse the uprights. Additionally, X-shaped brace assemblies may be used to provide further stability to the two uprights, using the same slots, and can be conveniently positioned at various locations on the uprights.

The pump jack scaffold may be readily adapted to be self-supporting on a generally horizontal surface on which the uprights are rested. Each of the uprights may be associated with an outrigger-type brace assembly effectively positioned to the same lateral side of the scaffold as the platform in order to react torques created by the weight of the platform and supported workmen and equipment as it hangs from the uprights. Each brace assembly comprises a first elongate brace with an upper end portion and a lower end portion, the lower end portion being engaged with the supporting surface, and a second elongate brace comprising a pair of opposing end portions. A pivot joint connects one end portion of the second brace to the first brace, intermediate its upper and lower end portions, and allows pivoting of the one brace end portion about a predetermined horizontal axis. First securing means secure the upper end portion of the first brace at a selectable vertical position to the associated upright. The first securing means include a fastener comprising an enlarged portion received in and shaped for displacement along the slot of the associated upright and a portion extending outwardly through the constricted mouth of the slot, a connector shaped to receive the outwardly-extending portion of the fastener, a complementary fastener cooperating with the outwardly-extending portion to releasably secure the connector to the pole, and a pivot joint connecting the upper end portion of the first brace to the connector for pivoting about an axis substantially parallel to the predetermined horizontal axis. Second securing means, similar to the first, secure the other end portion of the second brace to the pole. The relative angular orientation of the two braces and the vertical position of the brace assembly can be adjusted to properly engage the supporting surface. Once fixed to the associated upright with the two securing means, each brace assembly defines a rigid support. In such applications, cross-bracing between the uprights will also be desirable, rather than relying on connection of the uprights by the platform itself.

In each upright, the pole is preferably separable transverse to its length into upper and lower pole sections, to provide more manageable lengths for transportation or storage. A resilient bridging member is located in the interior of the pole and spans the upper and lower pole sections. The bridging member has an elongate central portion which is normally aligned with the central longitudinal axis of the pole, a pair of substantially parallel upper and lower passages formed in the central portion, and a plurality of web portions extending from the central portion. Each web portion terminates in a bracing portion engaged with a different corner of the pole. Each pole section is formed with a pair of aligned openings. The upper passage of the bridging member is registered with the pair of aligned openings of the upper pole section, and the lower passage of the bridging member is registered with the pair of aligned openings of the lower pole section. Releasable securing means are provided that comprise a pair of upper and lower locking members which are inserted through the registered openings and passages. A pair of the bracing portions preferably define between them a longitudinal structure-receiving slot which closely receives the extruded longitudinal structure of the pole thereby enhancing the torsional rigidity of the pole.

In preferred form, the pole of each upright is extruded with not one, but three longitudinal structures, each defining a lengthwise slot with a constricted mouth that opens into a different one of three pole side walls. The remaining side wall carries the friction material required for operation of the associated pump jack mechanism. This arrangement permits each of the uprights to receive outrigger brace assemblies oriented not only to react the torque created by the weight of the platform, but also providing longitudinal stability to the scaffold.

The foregoing summary highlights only certain aspects of the present invention. Other aspects will be apparent from a description below of preferred embodiments and will be more specifically defined in the appended claims.

DESCRIPTION OF THE DRAWINGS

The invention will be better understood with reference to drawings in which.

DESCRIPTION OF PREFERRED EMBODIMENTS

Figure 1:
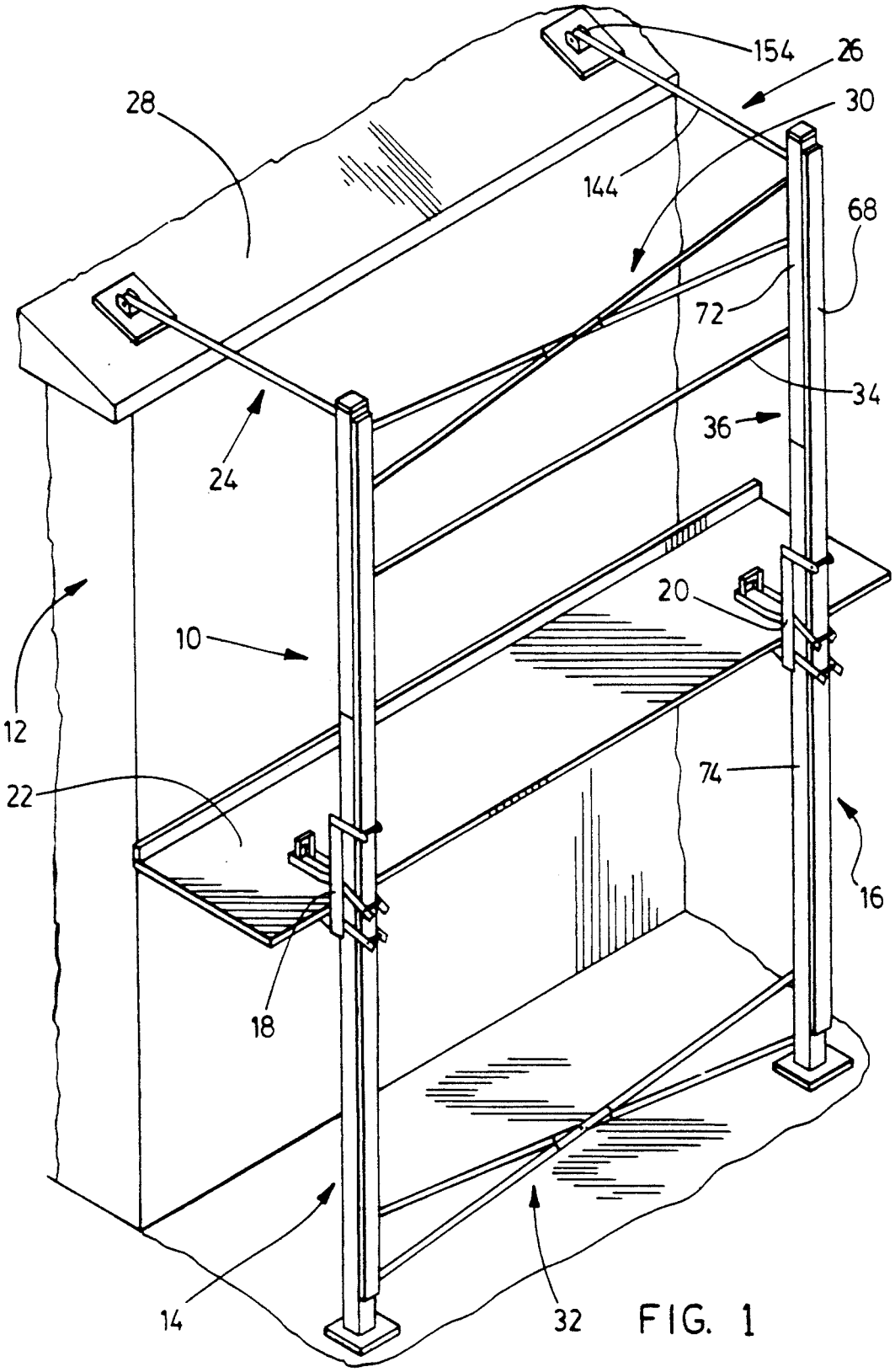
FIG. 1 is a perspective view of a pump jack scaffold beside a building.

Reference is made to FIG. 1 which shows a pump jack scaffold 10 supported against a building 12. The scaffold 10 includes a pair of uprights 14, 16, a pair of conventional jack mechanisms 18, 20 engaged with the uprights 14, 16, and a platform 22 supported by the jack mechanisms 18, 20. The scaffold 10 includes a number of brace assemblies. Brace assemblies 24, 26 secure the uprights 14, 16 to the roof 28 of the building 12. Upper and lower X-braces 30, 32 join the two uprights 14, 16 to create a more unitary structure. A horizontal brace 34 is displaceable on the uprights 14, 16 and may be used as a guard rail or to secure a tether which is part of a fall-arrestor.

Figure 3:
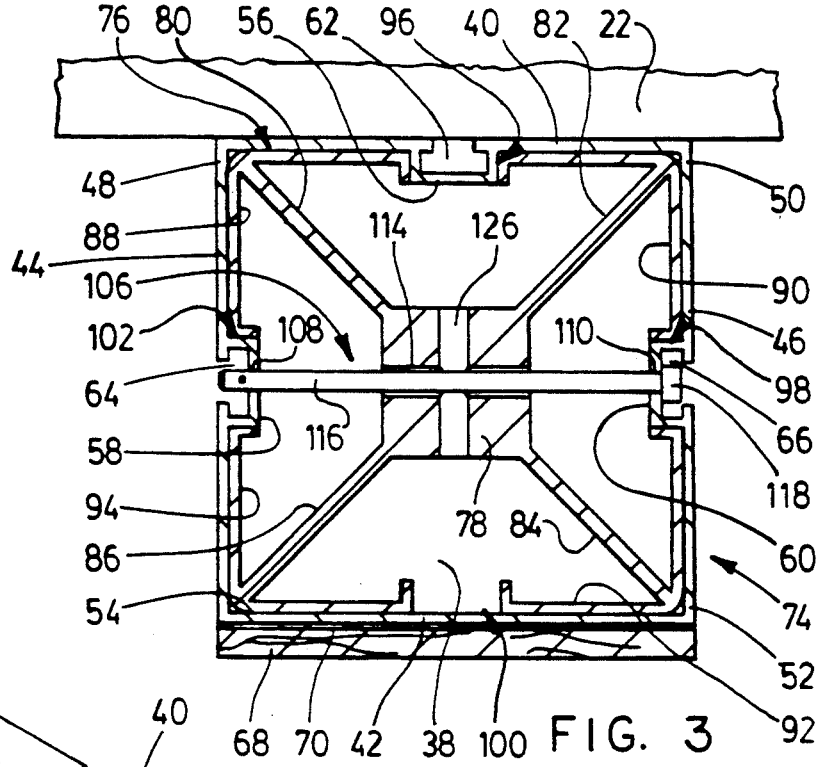
FIG. 3 is a cross-sectional view along the lines 3—3 of FIG. 2.

The rightmost upright 16 in FIG. 1 is typical. It includes an elongate extruded aluminum pole 36. As apparent in FIG. 3, the pole 36 has a with a hollow interior 38 and a generally rectangular outer transverse cross-section. It has a first pair of parallel, longitudinal sidewalls 40, 42, and a second pair of parallel longitudinal sidewalls 44, 46 that are oriented perpendicular to the first pair. Each sidewall presents a substantially flat outer surface. Together, the sidewalls 40–46 define four corner portions 48, 50, 52, 54.

Identical longitudinal structures 56, 58, 60 are extruded in the interior 38 of the pole 36 with three of the sidewalls 40, 44, 46. The extruded structure 56 associated with one sidewall 40 is typical. It defines a longitudinal T-slot 62 with a constricted longitudinal mouth that opens into the outer surface of the associated sidewall 40. The other longitudinal structures 58, 60 define comparable oppositely-disposed T-slots 64, 66 in the two parallel sidewalls 44, 46.

One sidewall 42 has a majority of its outer surface covered with a wood strip 68, a friction material appropriately engaged by the pump jack attached to the upright 16. This is done with double-sided pressure-sensitive waterproof tape 70. There are thus no rivets or screws that can potentially interfere with the operation of the pump jack, and the tendency for the friction material to break proximate to such fasteners is eliminated. The wood strip 68 may, however, be riveted or screwed to the pole 36 adjacent its upper and lower ends to ensure that the strip 68 does not separate from the pole 36 at such locations.

Figure 2:
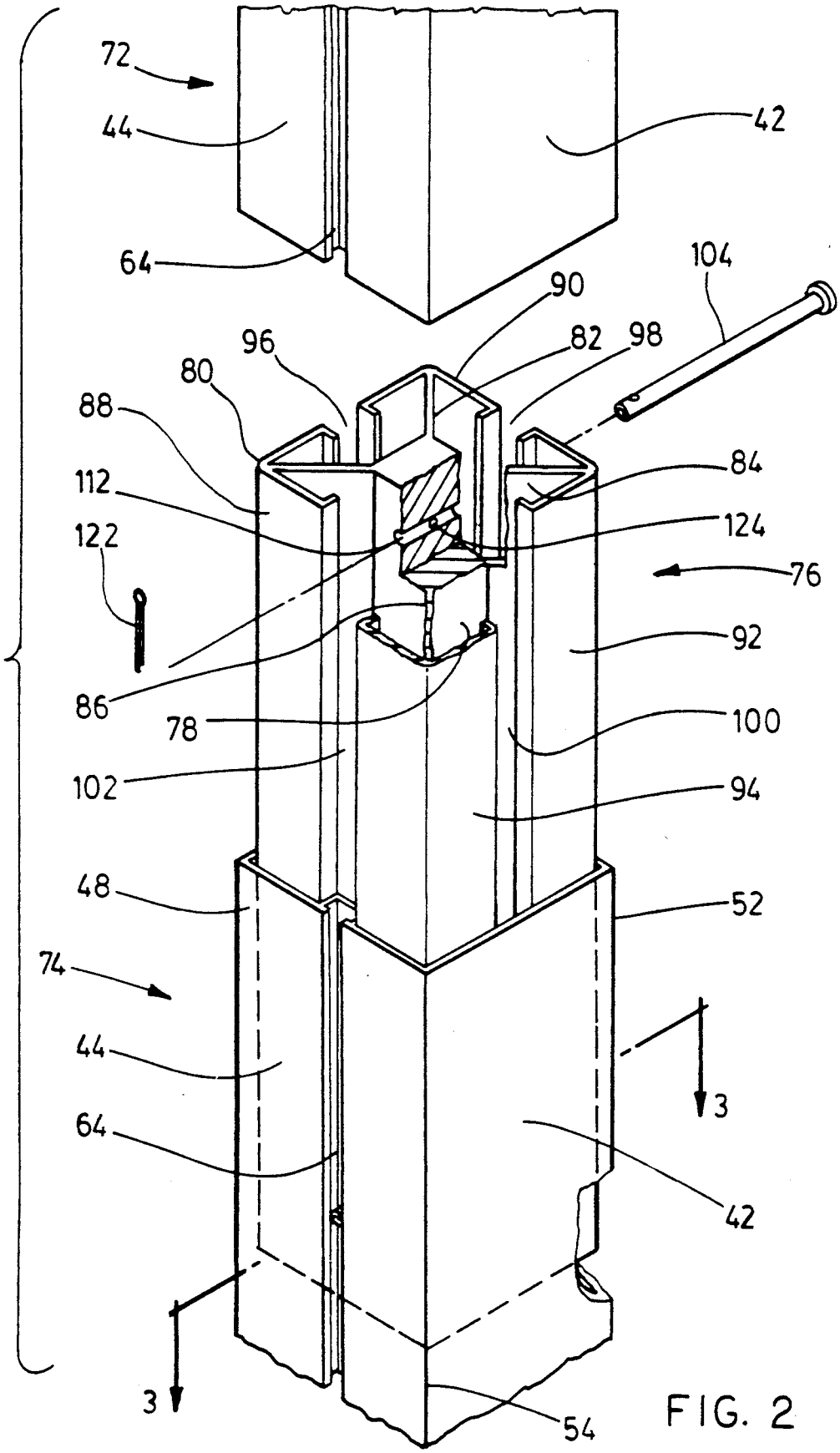
FIG. 2 is a fragmented perspective view of a joint in one upright of the scaffold.

The pole 36 is separable transverse to its length into upper and lower sections 72, 74. This is most apparent from FIGS. 2 and 3. A resilient, extruded aluminum bridging member 76 is located within the pole 36 and spans its upper and lower sections 72, 74. The bridging member 76 has an elongate central portion 78 which aligns with the central vertical axis of the pole 36. Four web portions 80, 82, 84, 86 extend substantially radially from the central portion 78. Each web portion 80, 82, 84 or 86 terminates in a bracing portion 88, 90, 92 or 94 with an arrowhead shape, that engages one of the corner portions 48, 50, 52, 54 of the pole 36. The bracing portions 88, 90, 92, 94 define between them four longitudinal structure-receiving slots 96, 98, 100, 102 dimensioned to closely receive each of the extruded longitudinal structures within the pole 36. Clearance between each longitudinal structure 56, 58 or 60 and any structure-receiving slot 96, 98, 100, 102 may be in the order of 15 thousands of an inch.

The presence of the internal extruded structures complicates the provision of a bridging member. A box-beam conforming to the interior 38 of the pole 36 creates problems relating to fabrication tolerances. If a loose fit is arranged, the pole 36 will tend to twist. If an attempt is made to conform more closely the internal shape of the pole 36, there is a risk that a box-beam type bridging member may not insert properly. The construction of the bridging member 76 overcomes such problems because the bracing portions 88, 90, 92, 94 are mounted on webs and can deflect slightly during installation of the bridging member 76. After installation, the bracing portions 88, 90, 92, 94 bear against the extruded longitudinal structures of the pole 36 and resist relative twisting of the pole sections 72, 74 at the junction.

The bridging member 76 is releasably joined to the pole sections 72, 74 with a pair of identical upper and lower locking pins 104, 106. Each pole section is formed with a pair of aligned openings to receive such pins 104, 106. One pair 108, 110 associated with the lower pole section 74 is typical and is apparent in FIG. 3. One opening 108 is formed in the longitudinal structure 58 defining one slot 64 and extends between the interior 38 of the pole 36 and the slot 64. The other opening 110 is formed in the opposing longitudinal structure 60 and extends between the interior 38 of the pole 36 and the opposing slot 66 defined by that structure 60. The aligned openings of the upper pole section 72 are similarly formed, but not illustrated.

The bridging member 76 has a first pair of upper and lower parallel horizontal passages 112, 114. The upper passage 112 is apparent in FIG. 2, and the lower passage 114 in FIG. 3. As apparent in FIG. 3, the lower passage 114 is registered with the aligned pair of openings 108, 110 in the lower pole section 74. The shaft 116 of the lower locking pin 106 extends through the aligned openings 108, 110 and the registered lower passage 114 of the bridging member 76. The head 118 of the lower locking pin 106 is dimensioned to seat entirely within the longitudinal slot 66. The length of the lower locking pin 106 is selected so that the end of the pin 106 locates entirely within the other slot 64. A cotter pin 120 is used to secure the end of the lower locking pin 106 within that other slot 64 and locates entirely within the other slot 64. This ensures that neither the lower locking pin 106 nor the cotter pin 120 protrudes beyond the exterior surfaces of the pair of sidewalls 44, 46 to interfere with the operation of the jack mechanism 20. The upper locking pin 104 is similarly received in the upper passage 112 and aligned openings of the upper pole section 72 and is similarly secured with a cotter pin 122.

The bridging member 76 can be received in the upper and lower pole sections 72, 74 in a variety of angular orientations rotated by 90 degrees relative to one another. To that end, the extruded structures 56–60 of the pole 36 are substantially identical and each is spaced angularly by 90 degrees from the immediately adjacent longitudinal structure. The four structure-receiving slots 96, 98, 100, 102 are substantially identical and equally spaced angularly by 90 degrees. The central portion 78 of the bridging member 76 also has a second pair of substantially parallel upper and lower passages 124, 126. These are rotated by substantially 90 degrees relative to the first pair 112, 114. The distance between the second pair of passages 124, 126 is equal to the distance between the first pair 112, 114. In this embodiment, the second pair of passages 124, 126 actually intersect the other pair 112, 114. Accordingly, if the bridging member 76 is rotated through 90 degrees, it can still be properly align with the upper and lower pole sections 72, 74 to permit introduction of the upper and lower locking pins 104, 106.

Figure 4:
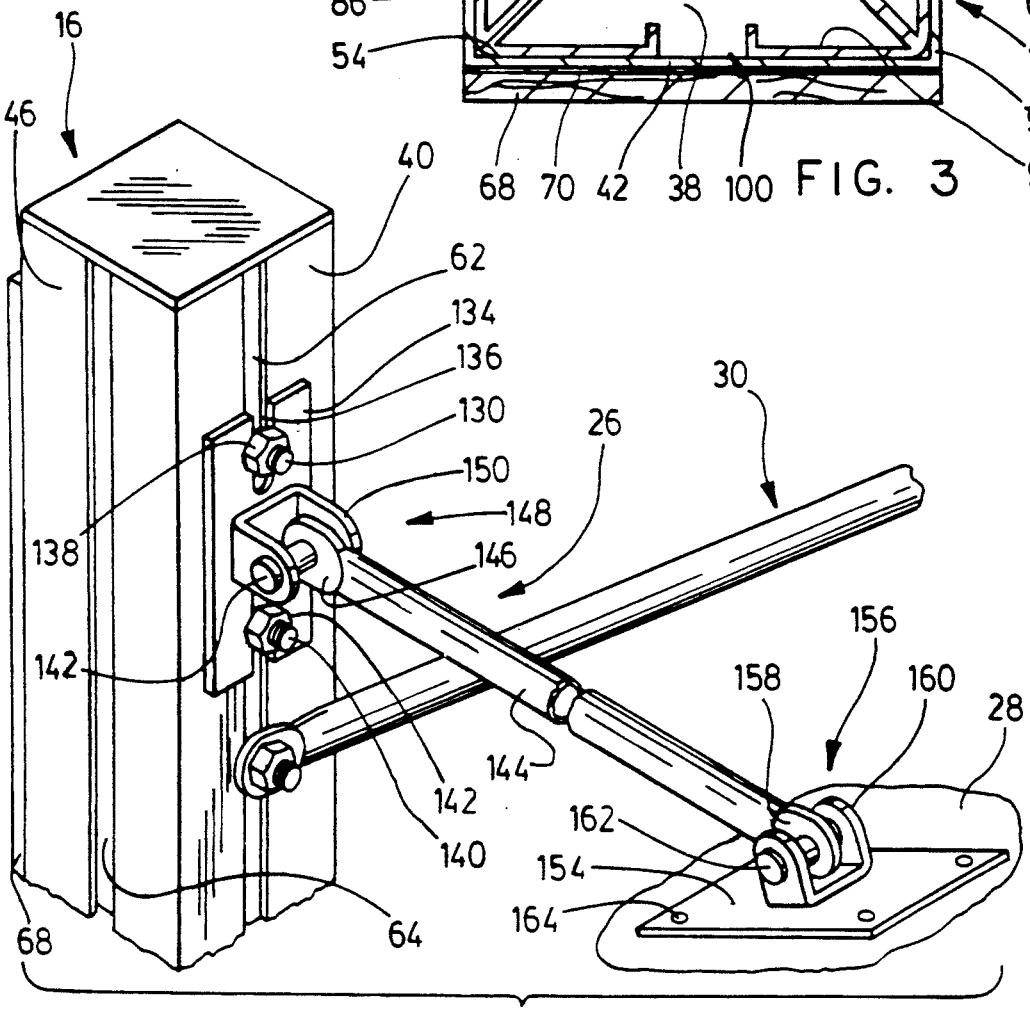
FIG. 4 is a fragmented perspective view detailing a brace assembly securing the upright to the roof of the building.

The brace assembly 26 used to secure the rightmost upright 16 to the roof 28 of the building is detailed in FIG. 4. A bolt 130 is used to fasten the brace assembly 26 to the pole 36 of the upright 16. The enlarged head (not apparent) of the bolt 130 is received in the slot 62 in the pole sidewall 40 opposite the wood friction material. (Details of how bolts are generally mounted to the slots will, however, will be more apparent from FIG. 6). The threaded shaft portion of the bolt 130 extends outwardly through the constricted mouth of the slot 62. A connector plate 134 has an upper open-ended slot 136 that receives the outwardly-extended shaft portion. A complementary nut 138 secures the connector plate 134 to the pole 36. A lower end portion of the connector plate 134 is similarly secured to the pole 36 with another bolt 140 and another nut 142.

The brace assembly 26 includes an elongate tubular brace 144 shown fragmented in FIG. 4. One end portion 146 of the brace 144 is fastened with a pivot joint 148 to the connector plate 134. The pivot joint 148 includes a clevis 150 which extends perpendicularly from the outer face of the connector plate 134. The brace end portion 146 is flattened to define a connector and formed with an aperture. A pivot pin 152 secures the apertured brace end portion 146 to the clevis 150, allowing pivoting of the brace end portion 146 about a horizontal axis relative to the connector plate 134. A plate-like fastening element 154 is secured with a pivot joint 156 to the opposing end portion 158 of the brace 144. That pivot joint 156 includes an a clevis 160 which protrudes perpendicularly from the fastening element 154. The other brace end portion 158 is flattened and apertured to define another connector portion. Another pivot pin 162 joins the other brace end portion 158 to the clevis 160 of the fastening element 154, allowing the fastening element 154 to pivot about a generally horizontal axis. This arrangement permits sufficient freedom of movement to properly seat the fastening element 154 against the sloped roof 28. Sets of apertures (only one aperture 164 specifically indicated) in the fastening element 154 permit nails or screws (not illustrated) to be used to fasten it to the roof 28. More complex pivot joints may be used to secure to building structures in various directions.

The upper and lower X-configured brace assemblies 30, 32 enhance the structural rigidity of the scaffold 10. The lower brace assembly 32 is typical. Its overall configuration is apparent from FIG. 1, and details regarding its connection to the upright 26 are apparent from FIGS. 5. It comprises two tubular braces 166, 168 which are flattened centrally and connected by a pivot pin (not illustrated). One end portion 170 of the brace 166 is flattened to define a connector portion. The head of a bolt 174 is located in the slot 62 of the upright's pole 36 with the threaded shaft of the bolt 174 extending outwardly through the mouth of the slot 62. The brace end portion 170 is apertured to receive the shaft, and a nut 178 secures the brace end portion 170 to the pole 36. The opposing end portion (not illustrated) is similarly flattened and apertured to define a connector portion which is bolted to the other upright 14. The other brace 168 is similarly mounted between the uprights 14, 16. The arrangement permits the X-brace assemblies 30, 32 to be positioned vertically on the uprights 14, 16, as required.

The transverse horizontal brace 34 is similarly fixed to the uprights 14, 16. It is essentially a tubular member with flattened, apertured end portions (not illustrated). Each end portion is fastened with a bolt located in the slot of an associated upright 14, 16 and a complementary nut, as has been described above with respect to the X-brace assemblies 30, 32. The advantage of the arrangement is that the horizontal brace 34 can be displaced upwardly and downwardly. It will generally be maintained at a level above the work platform 22, and raised or lowered as the platform 22 is itself raised or lowered. Wing nuts may be used to facilitate manual releasing and securing, without tools. T-bolts that do not require introduction through ends of the slots, but insert into a slot anywhere along its length and are then rotated through 90 degrees, may also be used. A tether may be attached in a conventional manner to the horizontal brace 34 and to a workman to arrest falls.

Figures 5, 6:
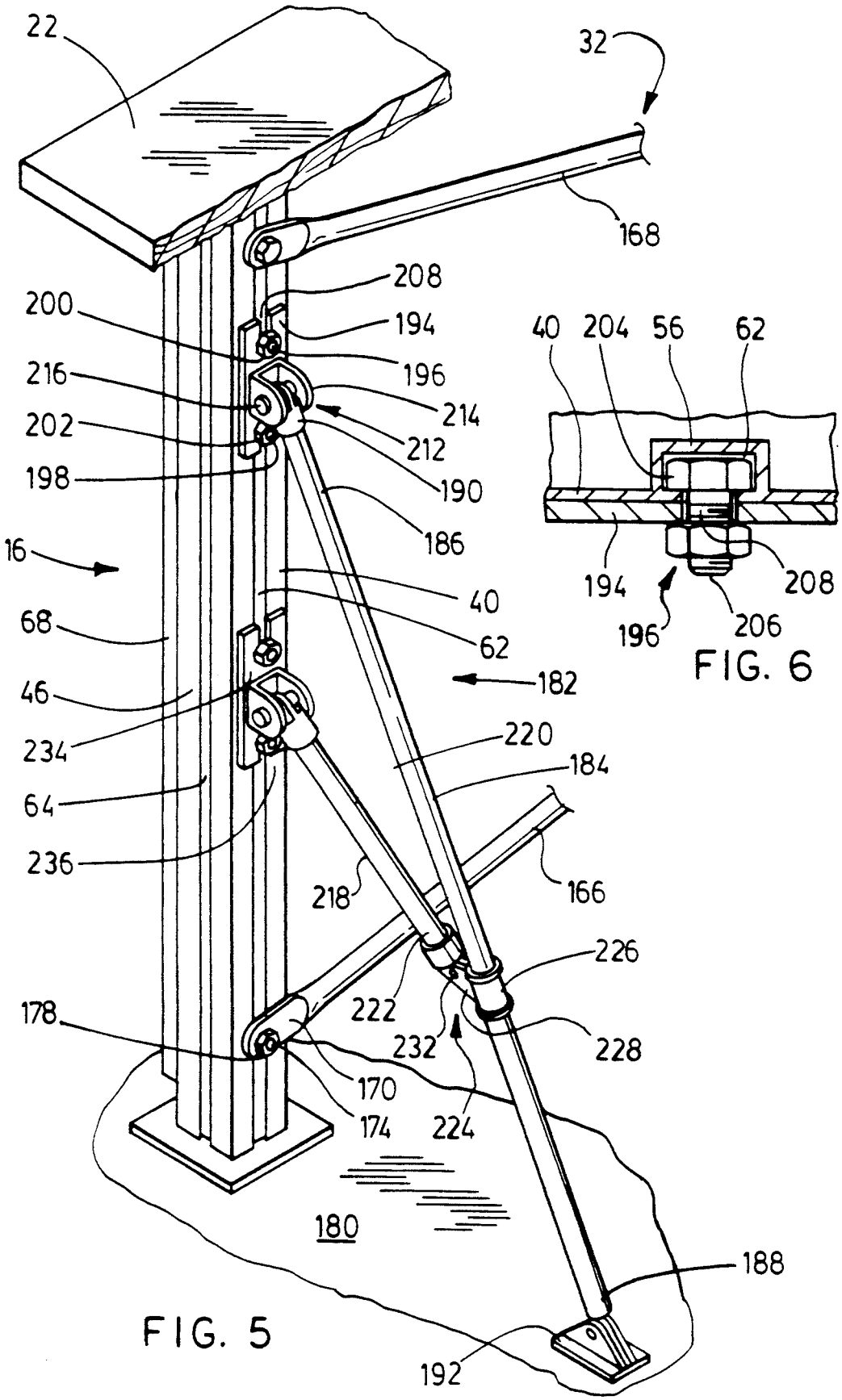
FIG. 5 is a fragmented perspective view of an outrigger which may be used to render the pump jack scaffold self-supporting; and, FIG. 6 is a fragmented elevational-type view showing a fastener used to secure the out-rigger to the upright.

Another advantage is that the pump jack scaffold 10 can be made essentially free-standing on the generally horizontal surface 180 which otherwise supports the uprights 14, 16. The X-configured brace assemblies 30, 32 will be used to join the uprights 14, 16 to form a more unitary structure, but the braces assemblies 24, 26 to the roof 28 would be eliminated. Each of the uprights 14, 16 may be associated with an outrigger-type brace assembly that reacts the torque applied by the platform 22 and its contents to uprights 14, 16. In FIG. 5, the rightmost upright 16 of the scaffold 10 is shown in combination with such an outrigger 182. The outrigger 182 comprises an elongate rigid brace 184 with upper and lower opposing ends 186, 188. The upper end portion 186 carries a conventional connector 190 with apertured tab, and the lower end portion 188 carries a pivoting base 192 that seeks an appropriate orientation against the horizontal supporting surface 180. The upper brace end portion 186 is secured to the upright 16 through a connector plate 194 comparable to the plate 134 described above. The connector plate 194 is secured to the pole 36 with upper and lower bolts 196, 198 and nuts 200, 202. The mounting of the upper bolt 196, which is typical, is illustrated in FIG. 6. It has an enlarged head portion 204 seated within the slot 62 of the pole 36 and shaped for displacement along the slot 62. Its threaded shaft 206 extends outwardly through the constricted mouth of the slot 62, and is received in a vertically opening slot 208 formed in the connector plate 194. The nut 200 cooperates with the threaded shaft 206 to releasably secure the plate 194 to the sidewall 40 of the pole 36. A pivot joint 212 is formed between the connector plate 194 and the upper end portion 186 of the brace 184, the pivot joint 212 comprising a clevis 214 with apertured arms extending from the plate 194, the connector 190 of the upper brace end portion 186, and pivot pin 216 which permit pivoting of the upper brace end portion 186 about a horizontal axis relative to the connector plate 194. The outrigger 182 includes a second shorter brace 218 with a pair of opposing upper and lower end portions 220, 222. The lower end portion 222 of the shorter brace 218 is secured intermediate the two ends of the other brace 184 by means of a pivot joint 224. The pivot joint 224 is constituted by a collar 226 fitted about the other brace 184, a pair of apertured parallel tabs (only one tab 228 apparent) which extend from the collar 226, a tabbed connector 230 carried by the lower end portion 222 of the shorter brace 218 and fitted between the pair of collar tabs, and a pivot pin 232. The upper end portion 220 of the shorter brace 218 is connected to the pole 36 with a connector plate 234 and a pivot joint 236 comparable to that used with the upper end portion 186 of the other brace 184. The arrangement permits the outrigger 182 to be appropriately positioned vertically and the angular orientation of the two constituent braces to be adjusted to properly engage the lower end portion 188 of the longer brace 184 with the horizontal supporting surface 180. A similar outrigger may be attached to the slot 66, essentially perpendicular to the outrigger 182, to provide longitudinal reinforcement of the scaffold structure. Similar outriggers would be attached to the other upright 14, but have not been illustrated.

It will be appreciated that particular embodiments of the invention have been described and that modifications may be made therein without departing from the spirit of the invention or necessarily departing from the scope of the appended claims.

I claim:

1. In a pump jack scaffold comprising a pair of uprights, a platform, a pair of jack mechanisms each secured to a different one of the uprights and supporting the platform; each of the uprights comprising an elongate extruded aluminum pole comprising a generally rectangular outer transverse cross-section, a pair of parallel side walls each having an outer surface, four corner portions, a hollow interior, and a longitudinal structure extruded with one of the pair of side walls and defining a longitudinal slot with a constricted mouth that opens into the outer surface of the one side wall and comprising friction material secured to the pole and covering the majority of the outer surface of the other of the pair of parallel side walls, the friction material being operatively engaged by the jack mechanism secured to the upright: the platform extending from one lateral side of the scaffold and the one of the pair of side walls of the pole of each upright faces to the one later side of the scaffold, the improvement in which the scaffold is adapted to be self-supporting on a generally horizontal surface on which the uprights are rested, each of the uprights being associated with a brace assembly that extends to the one lateral side, each of the brace assemblies comprising:

a first elongate brace with an upper end portion and a lower end portion, the lower end portion being engaged with the generally horizontal supporting surface;

a second elongate brace comprising a pair of opposing end portions;

a pivot joint connecting one of the end portions of the second brace to the first brace intermediate the upper and lower end portions of the first brace for pivoting about a predetermined horizontal axis;

first connection means for connecting the upper end portion of the first brace at a selectable vertical position to the upright associated with the brace assembly, the first connection means comprising a first fastener comprising an enlarged portion received in and shaped for displacement along the slot of the pole of the associated upright and comprising a portion extending outwardly through the constricted mouth of the slot of the pole of the associated upright, a first connector shaped to receive the outwardly-extending portion of the first fastener, a first complementary fastener cooperating with the outwardly-extending portion of the first fastener to releasably secure the first connector to the pole of the associated upright, and a first pivot joint connecting the upper end portion of the first brace to the first connector for pivoting about an axis substantially parallel to the predetermined horizontal axis; and, second connection means for connecting the other of the end portions of the second brace at a selectable vertical position to the upright associated with the brace assembly, the second connection means comprising a second fastener comprising an enlarged portion received in and shaped for displacement along the slot of the pole of the associated upright and comprising a portion extending outwardly through the constricted mouth of the slot of the pole of the associated upright, a second connector shaped to receive the outwardly-extending portion of the other fastener, a second complementary fastener cooperating with the outwardly-extending portion of the second fastener to releasably secure the second connector to the pole of the associated upright, and a second pivot joint connecting the other end portion of the second brace to the second connector for pivoting about an axis substantially parallel to the predetermined horizontal axis.

2. In a pump jack scaffold, an upright about which a pump jack mechanism is mounted, the upright comprising:

an elongate extruded aluminum pole separable transverse to its length into an upper pole section and a lower pole section, the pole comprising a generally rectangular outer cross-section transverse to its length, a first pair of parallel side walls each having a substantially flat outer surface, a second pair of parallel side walls oriented perpendicular to the first pair and each having a substantially flat outer surface, four corner portions defined by the side walls, a hollow interior, and a plurality of extruded longitudinal structures within the interior, the plurality of extruded longitudinal structures comprising a first structure extruded with one of the first pair of side walls and defining a first longitudinal slot with a constricted mouth that opens lengthwise into the outer surface of the one of the first pair of parallel side walls and comprising a second structure extruded with the other of the first pair of parallel side walls and defining a second longitudinal slot with a constricted mouth that opens lengthwise into the outer surface of the other of the first pair of parallel side walls, each of the upper and lower pole sections comprising a pair of aligned openings, one of the aligned openings of each pair extending between the interior of the pole and the first slot, the other of the aligned openings of each pair extending between the interior of the pole and the second slot;

a resilient bridging member located within the interior of the pole and spanning the upper and lower pole sections, the bridging member comprising an elongate central portion, at least a first pair of substantially parallel upper and lower passages formed in the central portion, the upper passage being aligned with the aligned pair of openings in the upper pole section, the lower passage being aligned with the aligned pair of openings in the lower pole section, and a plurality of web portions extending substantially radially from the central portion, each of the web portions terminating in a bracing portion engaged with a different one of the corner portions of the pole, the bracing portions being shaped to define between them a plurality of longitudinal structure-receiving slots spaced such that each of the plurality of extruded longitudinal structures is closely received in a different one of the structure-receiving slots;

means releasably securing the bridging member to the upper and lower pole sections, the securing means comprising a pair of upper and lower locking members, the upper locking member extending through the pair of aligned openings in the upper pole section and the upper passage of the bridging member, the lower locking members extending through the pair of aligned openings in the lower pole section and the lower passage of the bridging member, the securing means being contained within the first and second slots and the interior of the pole thereby avoiding interference with the pump jack mechanism; and, friction material secured to pole and operatively engaged by the pump jack mechanism, the friction material covering the majority of the outer surface of one of the second pair of side walls.

3. The pump jack scaffold of claim 2 in which:

each of the upper and lower locking members comprises a head portion located entirely within one of the first and second slots and a shaft portion extending through the bridging member to the other of the first and second slots; and, the securing means comprise an upper retaining member and lower retaining member, each of the retaining members being located entirely within one of the first and second slots and engaged with the shaft portion of a different one of the upper and lower locking members.

4. The pump jack scaffold of claim 2 in which:

the plurality of extruded longitudinal structures comprises a third structure extruded with the other of the second pair of side walls and defining a third longitudinal slot with a constricted mouth that opens lengthwise into the outer surface of the other of the second pair of parallel side walls;

the plurality of extruded longitudinal structures are substantially identical and each is spaced angularly by 90 degrees from an adjacent one of the extruded longitudinal structures;

the plurality of longitudinal structure-receiving slots consists of four slots that are substantially identical and equally spaced angularly by 90 degrees; and, the central portion comprises a second pair of substantially parallel upper and lower passages, the second pair of passages being rotated by 90 degrees relative to the first pair of passages and the distance between the second pair of passages being equal to the distance between the first pair of passages, the second pair of passages being oriented for simultaneous alignment with the paired openings of the upper and lower pole section;

whereby, the bridging member may be received in several orientations within the upper and lower pole sections.

* * * * *